US008082634B2

(12) United States Patent
Frank et al.

(10) Patent No.: US 8,082,634 B2
(45) Date of Patent: Dec. 27, 2011

(54) HANDLE FOR A HAND-HELD POWER TOOL

(75) Inventors: Mario Frank, Solothurn (CH); Ulrich Mueller-Boysen, Esslingen (DE); Joachim Schadow, Leinfelden-Echterdingen (DE); Juergen Wiker, Hangzhou (CN); Siegfried Keusch, Deizisau (DE); Tobias Herr, Stuttgart (DE); Marcus Schuller, Dettenhausen (DE)

(73) Assignee: Robert Bosch GmbH, Stuttgart (DE)

( * ) Notice: Subject to any disclaimer, the term of this patent is extended or adjusted under 35 U.S.C. 154(b) by 586 days.

(21) Appl. No.: 12/280,863

(22) PCT Filed: Oct. 1, 2007

(86) PCT No.: PCT/EP2007/060366

§ 371 (c)(1),
(2), (4) Date: Aug. 27, 2008

(87) PCT Pub. No.: WO2008/049710

PCT Pub. Date: May 2, 2008

(65) Prior Publication Data

US 2009/0064829 A1 Mar. 12, 2009

(30) Foreign Application Priority Data

Oct. 25, 2006 (DE) ..... 10 2006 050 169
Mar. 14, 2007 (DE) ..... 10 2007 012 301

(51) Int. Cl.
*B25G 1/04* (2006.01)

(52) U.S. Cl. ..... 16/436; 16/426; 16/427

(58) Field of Classification Search ..... 016/436, 016/431, 430, 422, 426; 81/489, 177.1; 173/162.1, 173/162.2, 205, 207; 473/300, 304, 305, 473/549, 568

See application file for complete search history.

(56) References Cited

U.S. PATENT DOCUMENTS

| | | | | |
|---|---|---|---|---|
| 4,067,090 | A | 1/1978 | Schenk | |
| 4,881,294 | A * | 11/1989 | Riedl | 16/426 |
| 4,896,426 | A * | 1/1990 | Nagashima | 30/383 |
| 4,936,394 | A * | 6/1990 | Ohtsu | 173/162.2 |
| 5,273,120 | A * | 12/1993 | Chang | 173/162.2 |
| 5,522,466 | A * | 6/1996 | Harada et al. | 173/162.2 |
| 5,692,574 | A | 12/1997 | Terada | |
| 5,740,586 | A * | 4/1998 | Gomas | 16/436 |
| 5,816,960 | A * | 10/1998 | Svoma et al. | 473/549 |
| 7,252,156 | B2 * | 8/2007 | Sugiyama et al. | 173/162.1 |
| 2005/0224244 | A1 * | 10/2005 | Kraenzler et al. | 173/162.1 |

FOREIGN PATENT DOCUMENTS

| | | |
|---|---|---|
| DE | 28 04 223 | 8/1979 |
| DE | 195 25 251 | 1/1996 |
| DE | 10 2004 017 761 | 11/2005 |
| DE | 10 2005 019 140 | 11/2006 |
| WO | 04/000505 | 12/2003 |

* cited by examiner

*Primary Examiner* — Chuck Y. Mah
(74) *Attorney, Agent, or Firm* — Michael J. Striker

(57) ABSTRACT

The invention describes a handle for a hand-held machine tool comprising a grip element (20) and a fastening element (10) for fastening the handle to a housing of a hand-held machine tool, wherein the fastening element (10) partially protrudes into the grip element (20) and a damping element (30) is provided between the grip element (20) and the fastening element (10), and wherein the fastening element (10) forms an undercut (12, 15) in the grip element (20).

5 Claims, 8 Drawing Sheets

HANDLE FOR A HAND-HELD POWER TOOL

BACKGROUND OF THE INVENTION

The present invention relates to a handle, in particular an additional handle, for a hand-held power tool.

Numerous power tools, such as angle grinders and rotary hammers, are equipped with an extra handle. To prevent vibrations that occur during operation of the power tool from being transmitted to the operator via the additional handle, additional handles are often provided with vibration-dampening means.

Publication DE 10 2004 017 761 A1, for instance, makes known a vibration-damped handle that includes a rigid assembly part for detachable attachment to the electrical hand-held power tool, and that includes a rigid grip part, in the case of which the assembly part extends into the grip part. A vibration-damping material is provided between the assembly part and the grip part, so that the assembly part is accommodated inside the grip part in the vibration-damping material. The assembly part is also provided with retaining elements that provide the assembly part with a sufficient hold in the grip part via the injected, vibration-damping material.

SUMMARY OF THE INVENTION

The present invention is directed to a handle for a hand-held power tool with a grip element and a fastening element, with which the handle may be attached to a housing of a hand-held power tool. The fastening element extends at least partially into the grip element. A damping element is provided between the grip element and the fastening element, and is made in particular of an elastic material, and most particularly of an elastomer. The grip element and the fastening element are therefore not in contact with each other.

It is provided that the fastening element forms an undercut in the grip element. Since the grip element and the fastening element are not in contact with each other, and are separated by the damping element, the fastening element forms a contactless undercut in the grip element. If the damping element fails due to damage or failure of the damping material, the undercut prevents the grip element from become separated from the fastening element. The undercut therefore ensures that the grip element may not be pulled off. The undercut also ensures that the grip element will not become overloaded, since the undercut limits the deflection of the grip element relative to the fastening element.

The fastening element is secured in the grip element, in particular via an axial undercut. The axial undercut serves to provide axial retention, thereby preventing the fastening element from being pulled off of the grip element. The fastening element is therefore blocked from being separated from the grip element in the axial direction.

In a further embodiment, the undercut also—or as an alternative—serves as a rotation lock for the fastening element in the grip element, thereby preventing the fastening element from being rotated relative to the grip element. The fastening element is therefore blocked from rotating in the grip element.

In a preferred embodiment, the fastening element forms an undercut in the grip element via an insert-rotate motion. This means that, when the handle is assembled, the fastening element is inserted in the grip element, so that it extends at least partially into the at least partially hollow grip element. The fastening element and the grip element are then rotated relative to each other along their longitudinal axis. This takes place, e.g., by rotating the fastening element by a certain angle around its longitudinal axis until the fastening element forms an undercut in the grip element. The fastening element therefore forms, with the grip element, a bayonet-type connection without touching the grip element directly.

In a further embodiment, the fastening element forms an undercut in the grip element via an insert-rotate-pull motion, which results in axial retention and a rotation lock. When the handle is assembled, the first step is to insert the fastening element in the grip element to the point where it extends at least partially into the at least partially hollow grip element. The fastening element and the grip element are then rotated relative to each other in the longitudinal axis. This takes place, e.g., by rotating the fastening element by a certain angle around its longitudinal axis until the fastening element forms an axial undercut in the grip element. The fastening element and the grip element are then pulled apart from each other until the fastening element is brought into an undercut position, thereby also providing a rotational lock. This relative motion of the fastening element and grip element in the longitudinal direction therefore takes place in a direction opposite to the longitudinal motion with which the fastening element is inserted in the grip element.

The fastening element may have different designs. It may be designed, e.g., essentially as a bolt, a pin, or the like. The end that extends out of the grip element may be provided, e.g., with a thread, so that the fastening element may be screwed into the housing of a hand-held power tool. In a simple embodiment, the fastening element may therefore be a screw that is inserted in the grip element of the handle and is screwed into the housing when the handle is installed on a hand-held power tool. Instead of a thread, a clamping device, for example, for connecting the handle with the housing of a hand-held power tool may be provided.

In a further alternative embodiment, the fastening element may be designed as a receiving sleeve with a nut. The receiving sleeve serves to receive a screw, which is connectable with the nut. A screw may be installed on the housing of the hand-held power tool. To attach the handle to the hand-held power tool, the screw is inserted in the receiving sleeve and is screwed together with the nut. The screw may be installed on the housing, e.g., using a clamping device.

To form an undercut in the grip element, the fastening element is provided with at least one undercut element on its end that extends into the grip element. Preferably, two or more undercut elements are provided. The undercut elements may be integrally formed with the fastening element, or they may be screwed, clipped, or bonded to the fastening element, or they may be joined therewith in any other manner.

The undercut elements are located radially—in particular—on the fastening element, where they are positioned, e.g., at an essentially right angle to the longitudinal axis of the fastening element. Two or more undercut elements may be located in a plane that is transverse to the longitudinal axis of the fastening element, i.e., next to each other, or they may be located in several planes that are transverse to the longitudinal axis, i.e., one behind the other. Several undercut elements located one after the other in the longitudinal direction of the fastening element provide additional protection against the grip element becoming torn off if the damping element should fail. Several undercut elements also improve the connection between the fastening element and the damping element, in particular when the damping element is composed of a thermoplastic elastomer that is injected between the fastening element and the grip element.

To provide a rotational lock—as an alternative or in addition—the undercut elements may also be oriented axially on the fastening element, thereby enabling them to engage in an axial recess.

The undercut elements may be designed to be flat, angled inwardly, bent, or curved.

To ensure that the fastening element may form an undercut by using an insert-rotate motion or an insert-rotate-pull motion relative to the grip element, the grip element includes a recess that is provided with at least one undercut element. The undercut elements are located radially—in particular—on the grip element such that they extend into the recess. The recess in the grip element for receiving the fastening element may also be a cavity in the grip element. The undercut elements of the grip element and the undercut elements of the fastening element may be designed, e.g., to complement each other. This means that the undercut elements of the grip element and the undercut elements on the fastening element are shaped such that the fastening element may be inserted through the recess and into the grip element. The undercut elements of the grip element and the fastening element are moved past each other axially until the fastening element extends far enough into the grip element that the fastening element may be brought into an undercut position relative to the grip element by rotating it around its longitudinal axis. As an alternative, the grip element may also be rotated around it longitudinal axis relative to the fastening element, or both elements—the grip element and the fastening element—may be rotated opposite to each other.

In a further embodiment, the fastening element may also be brought into a rotationally-locked position in the grip element by using a pulling motion. As an alternative, the grip element may also be moved relative to the fastening element by pulling, or both elements—the grip element and the fastening element—may be pulled apart from each other. The pulling motion takes place in the longitudinal direction of the handle and, in fact, in a direction opposite to the insertion motion with which the fastening element is inserted in the recess of the grip element. The undercut elements of the grip element are provided with a recess into which the undercut elements of the fastening element may engage when pulled.

As an alternative, the undercut of the fastening element relative to the grip element may be realized not with a bayonet-type lock, but with a latch-type lock, in which case a contactless and axial, in particular, undercut is formed. The grip element and the fastening element are not in contact with each other either in this embodiment of the locking of fastening element and grip element.

The latch-type lock is realized, e.g., by providing either the grip element or the fastening element, or both elements, with at least one latch element. The latch element is designed as an elastic spring element. The latch element may be a latch arm, a latch hook, or the like, or it may be an annular or ring-type latch element.

The fastening element and the grip element may be moved into the undercut relative to each other via mutual insertion, since, upon mutual insertion, the fastening element and the grip element slide past each other such that the latch element is elastically deformed. A simple insertion motion is therefore sufficient to provide at least axial retention of the fastening element in the grip element.

The damping element is preferably an elastomeric material, e.g., a thermoplastic elastomer or a foam that, once the fastening element has been inserted in the grip element, may be applied between the grip element and the fastening element, e.g., via injection-molding.

Instead of installing the damping element after the fastening element has been installed, the damping element may also be installed on the grip element before the fastening element is installed. The damping element is inserted in the grip element such that the fastening element is insertable in the undercut position using an insert-rotate motion or an insert-rotate-pull motion relative to the grip element with the damping element. In this embodiment, the damping element is shaped such that the fastening element with undercut elements may be inserted in the grip element. In particular, the damping element includes recesses for this purpose, which provide at least enough free space for insertion of the fastening element with undercut elements. The recesses in the damping element may have shapes that complement, e.g., the undercut elements. For instance, the fastening element may be inserted through the recesses in the damping element and into the grip element, and it may be moved in the grip element into an undercut position relative to the grip element via rotation around its longitudinal axis, to provide axial retention of the fastening element. The fastening element may also be brought into a rotationally-locked position in the grip element by using a pulling motion relative to the damping element. As an alternative, the grip element with damping element may also be moved relative to the fastening element by pulling, or both elements—the grip element with damping element, and the fastening element—are pulled apart from each other.

In this embodiment, the damping element is therefore inserted in the grip element before the fastening element is inserted in the grip element. The damping element may be designed as a separate component, which may be pre-fabricated, and which may be connected with the grip element on one side and with the fastening element on the other side. In particular, the fastening element may be connected with the damping element in a non-detachable manner, e.g., via bonding. As an alternative, the damping element may also be manufactured together with the grip element, e.g., in a two-component injection-molding procedure.

A further subject of the present invention is a method for manufacturing an inventive handle, with which the fastening element may be inserted in the grip element such that the fastening element forms an undercut in the grip element.

With the method, the fastening element is brought into an axial undercut position in particular, which ensures axial retention if the damping element should fail. In particular, the fastening element is also brought into an undercut position that serves as a rotational lock relative to the grip element.

In a preferred embodiment, the fastening element is inserted in the grip element via an insert-rotate motion such that the fastening element forms an undercut in the grip element.

This embodiment may be realized, e.g., by providing the grip element with a recess and undercut elements that extend into the recess, and by providing the fastening element with at least one undercut element. The undercut elements of the fastening element and the grip element may be designed, e.g., to complement each other. In a first step, for example, the fastening element may be inserted through the recess and into the grip element. An insertion motion refers to a longitudinal motion of the fastening element relative to the grip element, with which the fastening element is inserted in the grip element. In a second step, the fastening element is then rotated around its longitudinal axis and is brought into an undercut position relative to the grip element. Finally, the damping element is located between the grip element and the fastening element, preferably by injecting a thermoplastic elastomer.

The fastening element is thereby kept separated from the grip element, and a contactless undercut is formed.

As an alternative, the fastening element may also be inserted in the grip element by using an insert-rotate motion, if the damping element was previously applied to the grip element.

In a further embodiment, the fastening element is inserted in the grip element via an insert-rotate-pull motion such that the fastening element forms an undercut in the grip element, which also provides a rotational lock.

This embodiment may be realized, e.g., providing the grip element with a recess and undercut elements that extend into the recess, and by providing the fastening element with at least one undercut element. The undercut elements of the fastening element and the grip element may be designed, e.g., to complement each other. In a first step, for example, the fastening element may be inserted through the recess and into the grip element. In a second step, the fastening element is then rotated around its longitudinal axis and is brought into an undercut position relative to the grip element. In a further, third step, the fastening element is moved into an undercut position via a pulling motion relative to the grip element, thereby also securing the fastening element against rotation. A pulling motion refers to a longitudinal motion that takes place opposite to the insertion motion of the first method step, i.e., the fastening element and the grip element are moved away from each other in the longitudinal direction. Finally, the damping element is located between the grip element and the fastening element, preferably by injecting a thermoplastic elastomer. The fastening element is thereby kept separated from the grip element, and a contactless undercut is formed.

As an alternative, in this embodiment, the fastening element may also be inserted in the grip element by using an insert-rotate motion, if the damping element was previously applied to the grip element.

In an alternative embodiment of the method for manufacturing an inventive handle, the fastening element is inserted in the grip element via an insert-rotate motion such that the fastening element forms an undercut in the grip element.

This embodiment may be realized, e.g., by providing one of the two elements—the grip element or the fastening element—with a recess for receiving the other element. For example, the grip element is provided with a recess in which the fastening element may be inserted. In addition, at least one of the two elements—the grip element or the fastening element—includes at least one latch element, which is elastically deformable. For example, the edge of the recess may be rigid in design, while the fastening element is provided with one or more latch elements. The rigid edge of the recess and the at least one latch element of the fastening element are designed to correspond with each other such that, when the grip element and the fastening element are inserted in each other, the edge and the latch element slide past each other, and the latch element is elastically deformed.

According to this embodiment of the method, therefore, the grip element and the fastening element are inserted in each other to the extent that they reach a contactless undercut position relative to each other. Finally, the intermediate space may be filled, e.g., with an elastic material, e.g., an elastomer or a foam, as the damping element, e.g., via injection-molding.

The undercut elements of the fastening element and the grip element may be designed, e.g., to complement each other. In a first step, for example, the fastening element may be inserted through the recess and into the grip element.

The inventive handle is preferably designed in the shape of a rod or stem or the like. The grip element of the handle is essentially cylindrical in shape. In a simple embodiment, this may be a cylinder. In a more advanced embodiment, the cylindrical grip element may also be adapted to the ergonomy of the human hand by providing it, e.g., with different diameters along its longitudinal axis, in deviation from a purely cylindrical shape. The grip element may be rotationally symmetrical, thereby enabling the user to grip the handle in any direction. As an alternative, the grip element may also be adapted especially to the ergonomy of the human hand in such a special manner that a first region of the grip element serves especially as a contact surface for the hand surface, and a second region serves as a contact surface for the fingers.

The grip element may be designed as one piece or a multiple-component part. A handle with a single-pieced grip element has, e.g., a rod-shaped grip element made, e.g., of a thermoplastic plastic, with a fastening element on one end of the grip element. In contrast, a two-pieced grip element includes, e.g., a grip core composed of a hard material, e.g., a thermoplastic plastic, and a grip shell composed of a soft material, e.g., an elastic plastic. The grip shell may enclose the grip core entirely or partially.

The inventive handle may also be designed in the shape of a bracket handle. A bracket handle is basically U-shaped. At least one of the two ends of the legs of the U-shaped handle is provided with a fastening element for attachment to a housing of a hand-held power tool. Both ends of the legs of the U-shaped handle may also each be provided with a fastening element.

The inventive handle is suited, in particular, for use as an additional handle for a cordless or mains-operated hand-held power tool, e.g., an angle grinder or a rotary hammer. A further subject of the present invention, therefore, is a hand-held power tool that includes an inventive handle.

BRIEF DESCRIPTION OF THE DRAWINGS

The present invention is explained in greater detail below with reference to the attached drawing. The following schematic illustrations are provided.

DETAILED DESCRIPTION OF THE PREFERRED EMBODIMENTS

Figure 1:
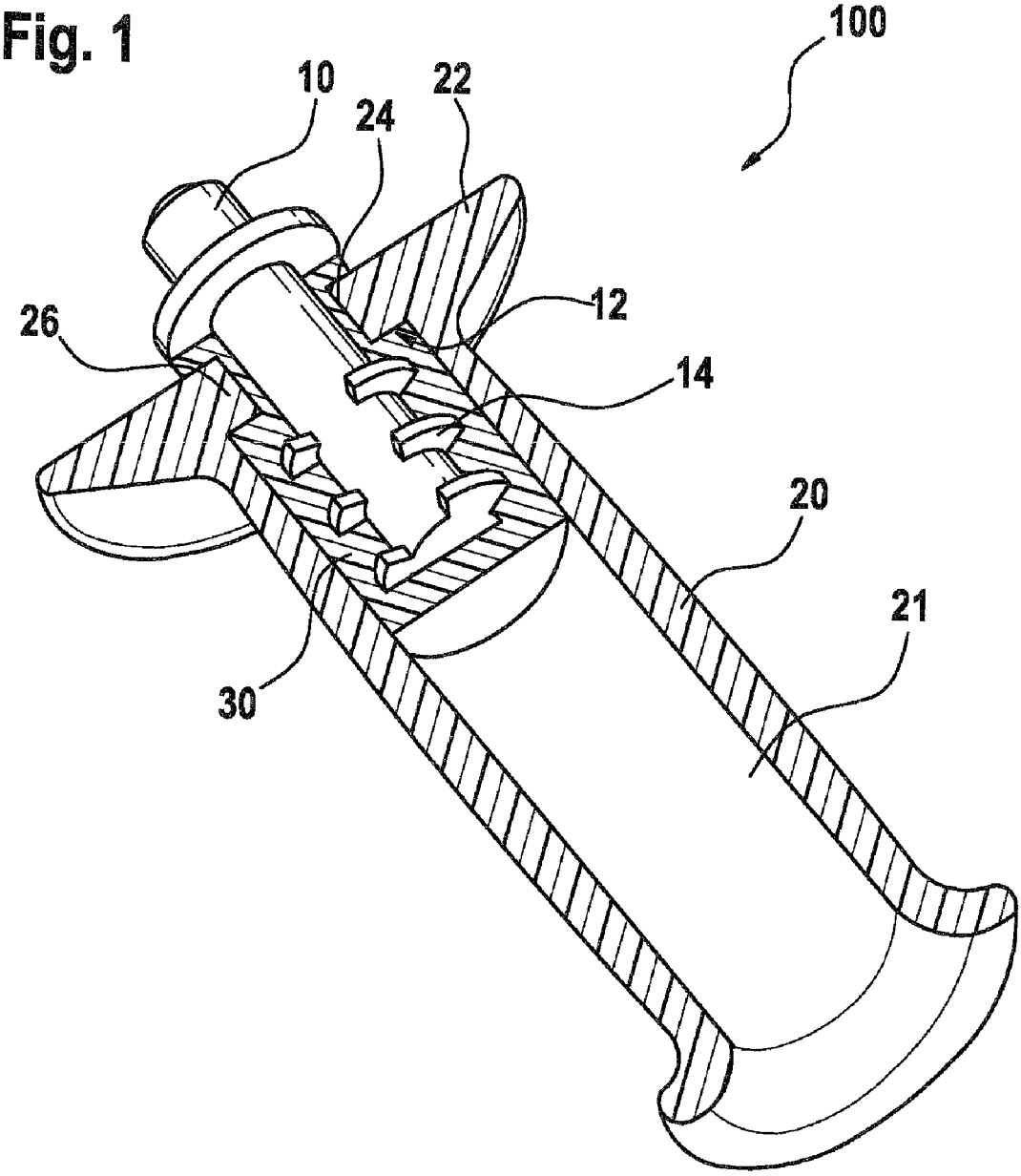
FIG. 1 shows a first embodiment of an inventive handle with a fastening element in an axial undercut position relative to a grip element

A first embodiment of an inventive handle 100 is shown in FIG. 1. Handle 100 is suitable for use as an additional handle for a hand-held power tool (not shown). It includes a grip element 20, a fastening element 10, and a damping element 30 located between grip element 20 and fastening element 10. Grip element 20 and damping element 30 are shown as cross-sections in FIG. 1. Grip element 20 is stem-like in design and is cylindrical in shape. A cavity 21 is formed inside grip element 20. Handle 100 may be connected with a housing of the hand-held power tool via a fastening element 10, which extends at least partially into grip element 20. Fastening element 10 may include, e.g., a thread (not shown), with which it may be screwed into the housing. Grip element 20 includes a flange-type expansion 22 on its end facing fastening element 10.

To receive fastening element 10, grip element 20 is provided with a recess 24. Fastening element 10 forms a contactless undercut 12 in grip element 20. Undercut 12 is contactless, since fastening element 10 and grip element 20 are separated from each other via damping element 30, i.e., fastening element 10 and grip element 20 do not touch each other. If damping element 30 should fail, undercut 12 prevents fastening element 10 from becoming separated from grip element 20. Undercut 12 is an axial undercut in particular, which provides axial retention of fastening element 10. Undercut 12 is realized in particular by using an insert-rotate motion, as described with reference to the embodiment shown in FIG. 1 through 5. As an alternative, an undercut of fastening element 10 may also be realized in grip element 20 by using an insert-rotate-pull motion, as depicted in the embodiment shown in FIGS. 6 through 8.

Figure 2:
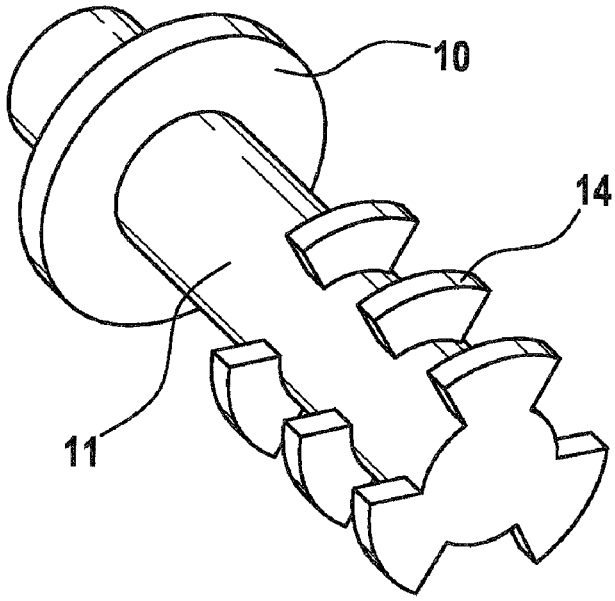
FIG. 2 shows the fastening element in FIG. 1
Figure 5:
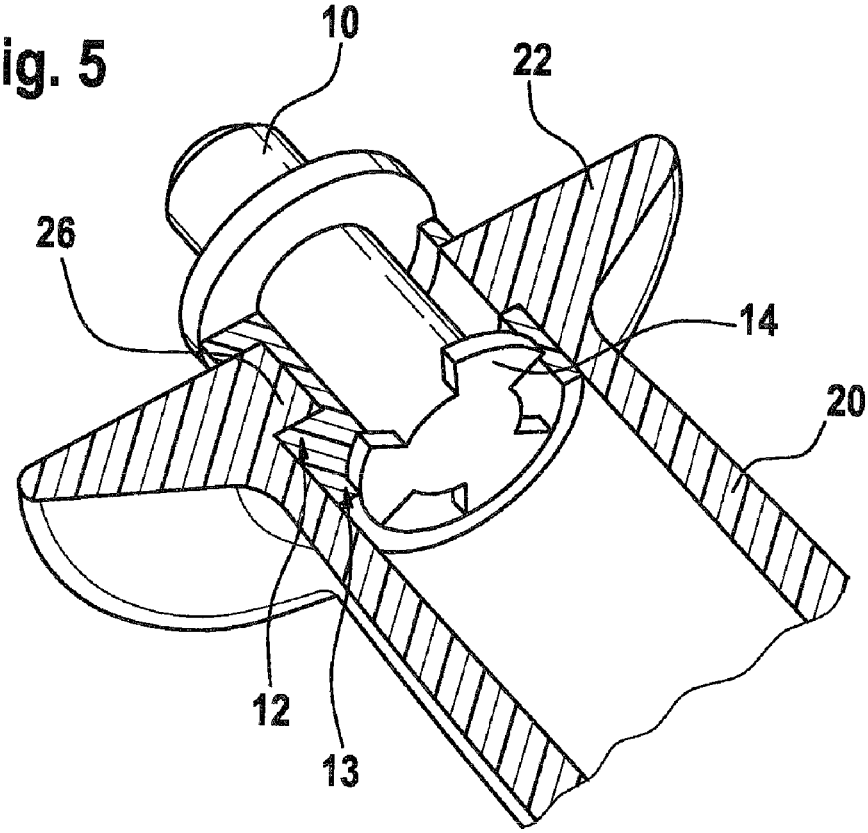
FIG. 5 shows the handle in FIG. 4 with a fastening element

Fastening element 10 includes undercut elements 14, which are located radially on shank 11 of fastening element 10. In the embodiment shown in FIGS. 1 and 2, three undercut elements 14 are provided in a plane perpendicular to the longitudinal axis of fastening element 10, i.e., three undercut elements 14 are located next to each other. Undercut elements 14 as shown in FIGS. 1 and 2 are also located one behind the other, i.e., they distributed on three planes that are transverse to the longitudinal axis. As shown with fastening element 10 in FIG. 5, it is also possible, as an alternative, to provide fewer undercut elements 14 than are shown in FIGS. 1 and 2. In FIG. 5, for instance, only three undercut elements 14 are located one next to the other, i.e., in a plane that is transverse to the longitudinal axis of fastening element 10. It is also possible to provide more undercut elements than are shown in FIGS. 1 and 2 (not shown). In the embodiment shown, undercut elements 14 are integrally formed with shank 11.

Figure 3:
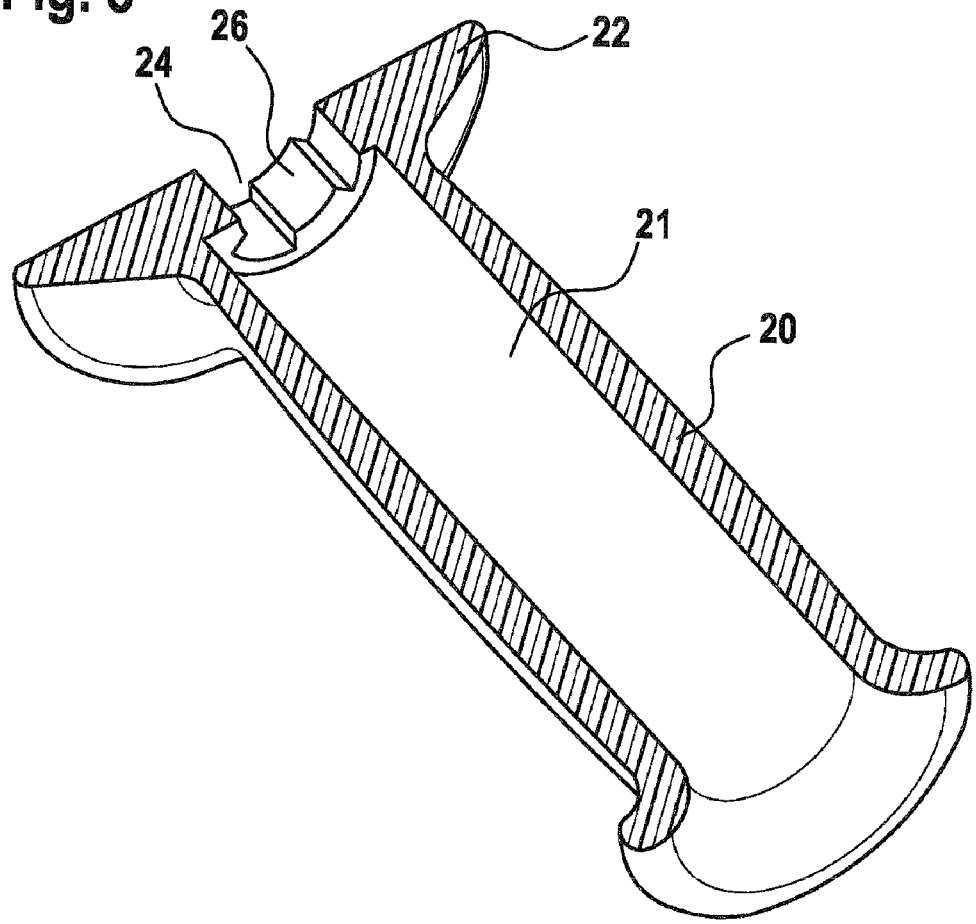
FIG. 3 shows the grip element in FIG. 1

In a first embodiment, which is shown in FIGS. 1 through 3, fastening element 10 forms an undercut 12 in grip element 20 via a rotate-insert motion only after damping element 30 has been inserted in grip element 20. In a second embodiment, which is shown in FIGS. 4 through 5, fastening element 10 is connected with grip element 20 via a rotate-insert motion only after damping element 30 has been installed on grip element 20.

In the sectional view of grip element 20 in FIG. 3, it is shown that recess 24 in grip element 20 is provided with undercut elements 26, which are designed to complement undercut elements 14 of the fastening element. Undercut elements 26 are also located radially on grip element 20, so that they extend into recess 24 or cavity 21. Fastening element 10 with undercut elements 14 may therefore be inserted through recess 24 and into grip element 20. Fastening element 10 is inserted in grip element 20 so far that undercut elements 14 are separated from undercut elements 26 of grip element 20 in the longitudinal direction. Via a rotational motion around its longitudinal axis, fastening element 10 is then brought into an undercut position 12 relative to grip element 10—specifically, relative to undercut elements 26 of grip element 10—without touching grip element 20. Damping element 30 may then be installed between fastening element 10 and grip element 20, e.g., by injecting a thermoplastic elastomer.

Figure 4:
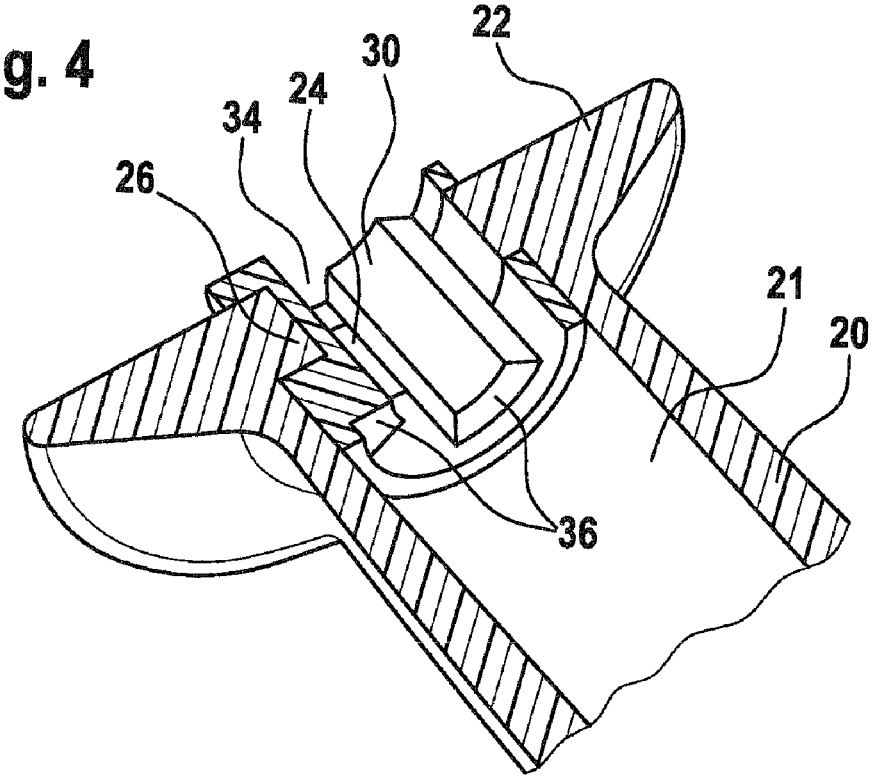
FIG. 4 shows a second embodiment of an inventive handle, without a fastening element

In the second embodiment as shown in FIGS. 4 through 5, damping element 30 is installed in grip element 20 (FIG. 4) before fastening element 10 is installed in grip element 20 (FIG. 5). For example, damping element 30 may be injection-molded onto grip element 20 as a thermoplastic elastomer. Damping element 30 also includes a recess 34 and is provided with projections 36 located radially on damping element 30, so that they extend into recess 34. In the embodiment shown, projections 36 on the damping element are designed to complement undercut elements 14 of fastening element 10. Fastening element 10 may therefore be inserted through recess 34 and into grip element 20 with damping element 30. Fastening element 10 is inserted in grip element 20 until, via a rotational motion of fastening element 10 around its longitudinal axis, undercut elements 14 extend behind projections 36 of damping element 30. Fastening element 10 is therefore simultaneously brought into an axial undercut position 12 relative to grip element 20 without touching grip element 20.

Figure 6:
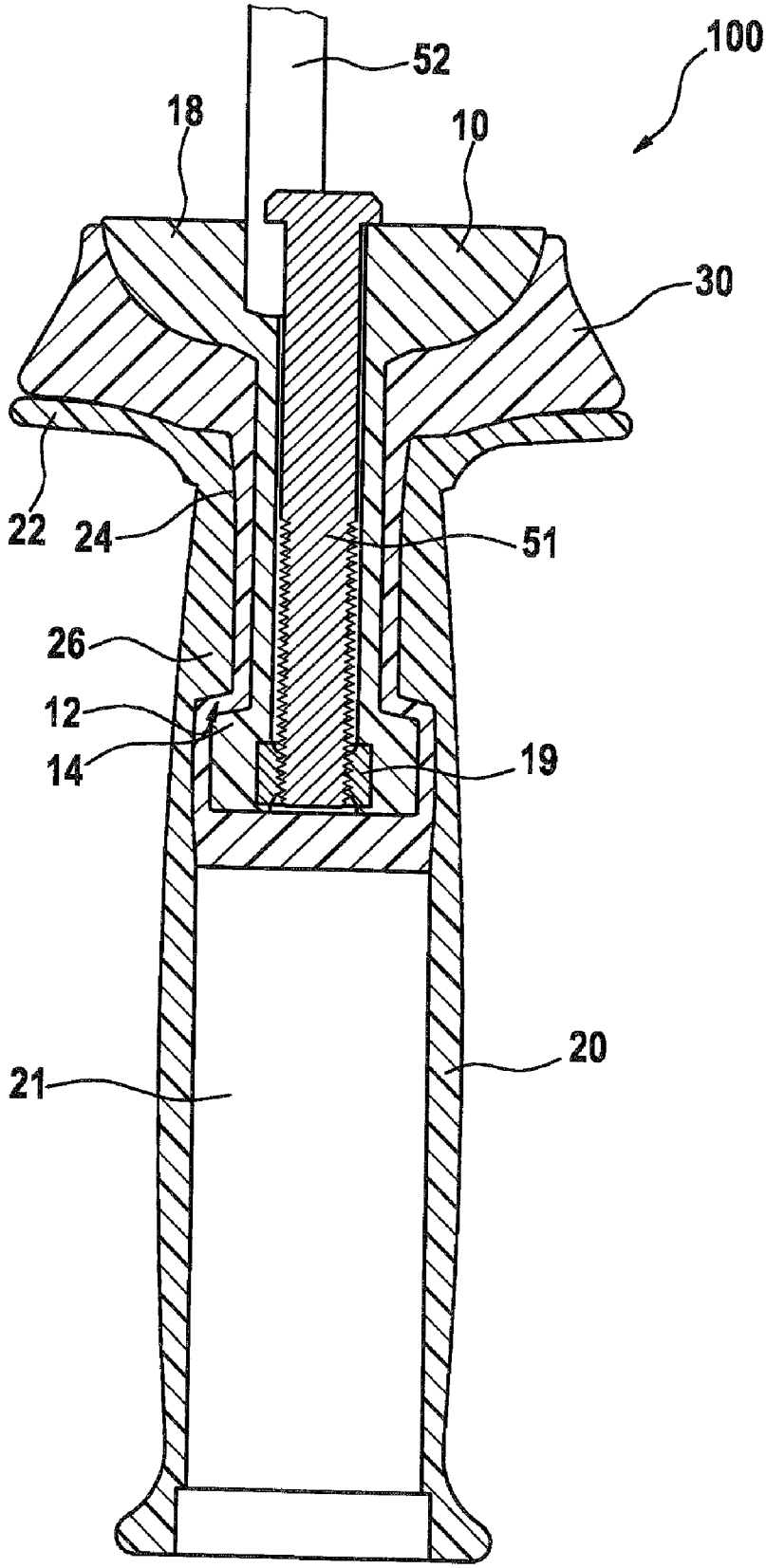
FIG. 6 shows a further embodiment of an inventive handle, with an additional rotational lock
Figure 7:
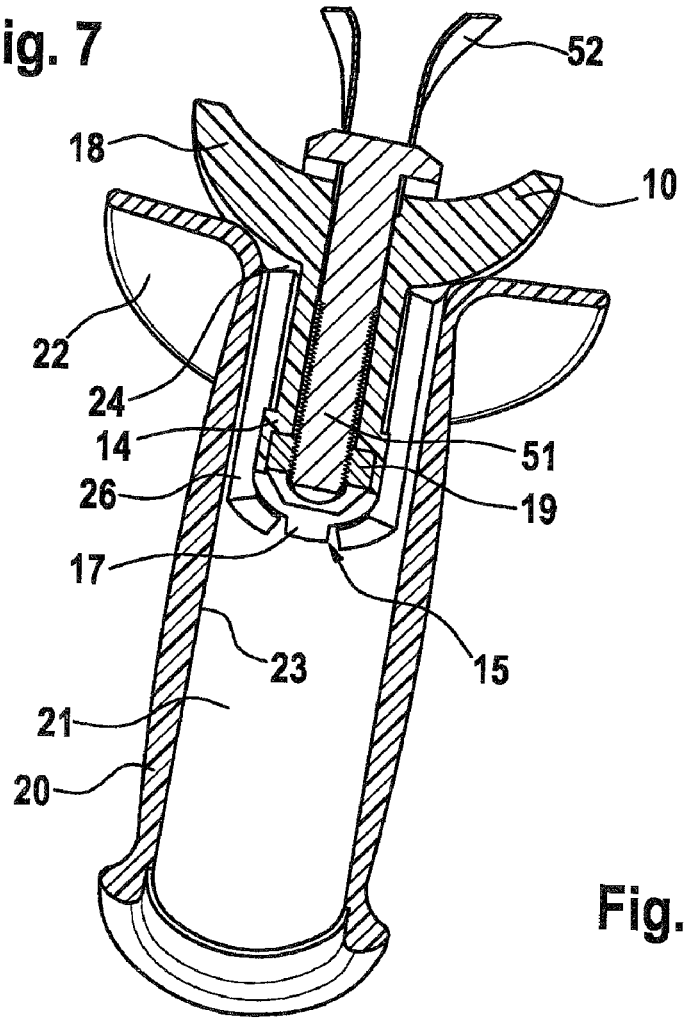
FIG. 7 shows the handle in FIG. 6 without a damping element, in a longitudinal sectional view
Figure 8:
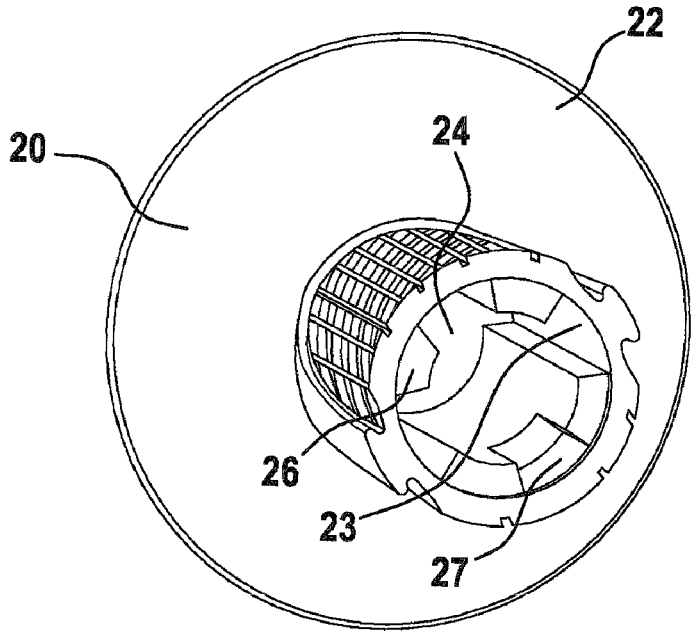
FIG. 8 shows the grip element of the handle in FIG. 6, in a perspective view

In an alternative embodiment of a handle 100 as shown in FIGS. 6 through 8, fastening element 10 forms not only an axial undercut 12 in grip element 20, but also an undercut 15 that serves as a rotational lock.

In the embodiment shown in FIGS. 6 through 8, fastening element 10 includes a receiving sleeve 18 and a nut 19. Receiving sleeve 18 serves to receive a screw 51, and is made, e.g., of a hard plastic. Screw 51 may be installed on the housing of a hand-held power tool (not shown) using a clamping device 52 shown in FIG. 6, e.g., a clamp. To attach handle 100 to a hand-held power tool, screw 51 is inserted in receiving sleeve 18 and is screwed together with nut 19.

A damping element 30, e.g., made of a thermoplastic elastomer, is located between fastening element 10 and grip element 20, so that fastening element 10 and grip 20 element do not touch each other.

To form an axial undercut 12, grip element 20 is provided with undercut elements 26 that, as shown in the perspective illustration in FIGS. 7 and 8, are located radially on inner wall 23 of grip element 20 so that they extend into cavity 21 or recess 24. In the embodiment shown, undercut elements 26 are integrally formed with inner wall 23 of grip element 20. In the same manner, sleeve 18 of fastening element 10 is also provided with undercut elements 14. Undercut elements 14 of fastening element 10 and undercut elements 26 of grip element 20 are designed to complement each other.

To form an undercut 15 that also serves as a rotation lock, sleeve 18 also includes at least one undercut element 17, which extends in the axial direction relative to undercut elements 14. In the same manner, at least one undercut element 26 of grip element 20 is provided with a recess 27 in which undercut element 17 may engage in a contactless manner.

Undercuts 12, 15 are realized using an insert-rotate-pull motion of fastening element 10 relative to grip element 20. Undercut elements 26 of grip element 20 and undercut elements 14 of sleeve 18 are designed to complement each other, so that sleeve 18 of fastening element 10 may be inserted through recess 24 and into grip element 20. Sleeve 18 is inserted into grip element 20 until it may be moved—via rotation about its longitudinal axis—into an undercut position 12 relative to grip element 20, i.e., relative to undercut elements 26. Sleeve 18 is then pulled in order to also move it into a rotationally-locked undercut position 15 in grip element 10. Pulling sleeve 18 with fastening element 10 relative to grip element 20 is therefore a longitudinal motion that takes place in the direction opposite to the insertion of fastening element 10 in grip element 20. When pulled, at least one undercut element 17 of sleeve 18 engages in a recess 27 in an undercut element 26 of grip element 20. Undercut 15, which also serves as a rotation lock, is also a contactless undercut, since a damping element 30 is provided between grip element 20 and sleeve 18.

Figure 9:
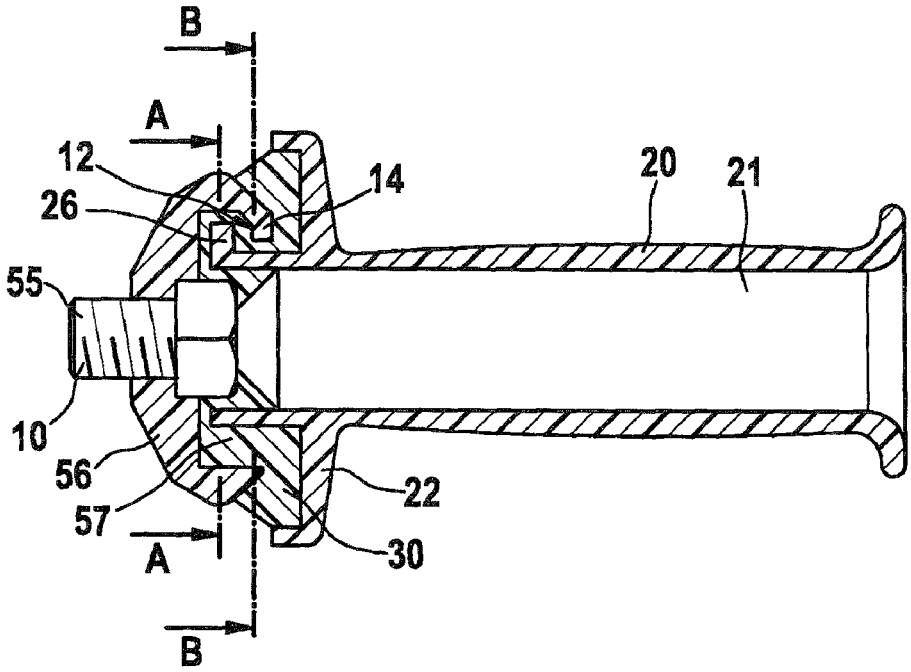
FIG. 9 shows an alternative embodiment of an inventive handle with a fastening element in an axial undercut position relative to a grip element

In an alternative embodiment as shown in FIG. 9, fastening element 10 forms—via a simple insertion motion—an undercut 12 in grip element 20. After fastening element 10 has been inserted in grip element 20, damping element 30 is installed between grip element 20 and fastening element 10. In the embodiment shown, fastening element 10 is composed of two pieces. It includes a type of threaded bolt 55 and a carrier element 56. Carrier element 56 may be made, e.g., of a thermoplastic plastic that is injection-molded onto threaded bolt 55.

Figure 9A:
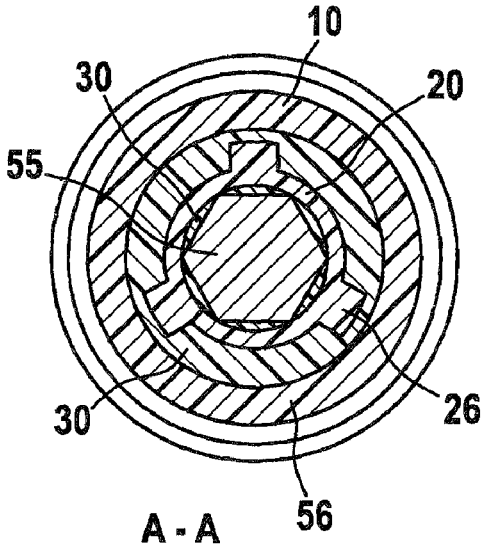
Figure 9B:
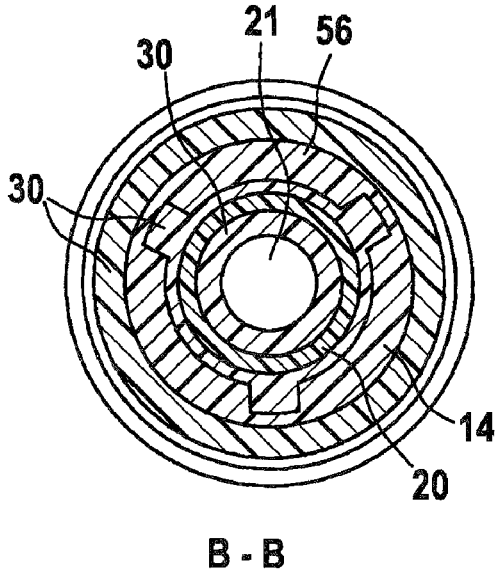

In the sectional views shown in FIGS. 9*a* and 9*b*, it is shown that complementary undercut elements 14, 26 are formed on carrier element 56 of fastening element 10 and on grip element 20. Undercut elements 14, 26 are located on fastening element 10 and grip element 20 such that they are separated by 120°. This makes it possible, during assembly, to mutually insert grip element 20 and fastening element 10 in the longitudinal direction of the handle, and to then rotate them by approximately 60° relative to each other around the longitudinal axis, thereby bringing fastening element 10 into an axial undercut position relative to grip element 20. In the undercut position, grip element 20 and fastening element 10 are inserted into each other to the extent that undercut elements 14 of fastening element 10 are separated from undercut elements 26 of grip element 20 in the longitudinal direction and therefore do not touch each other. Damping element 30 may then be installed between fastening element 10 and grip element 20, e.g., via injection-molding of a thermoplastic elastomer.

In contrast to the embodiment shown in FIGS. 1 through 3, carrier part 56 of fastening element 10 is provided with a recess 57 into which grip element 20 is inserted. Undercut elements 14 of fastening element 10 extend radially into recess 57. Undercut elements 26 of grip element 20 are oriented radially outwardly in the manner of a collar.

Figure 10:
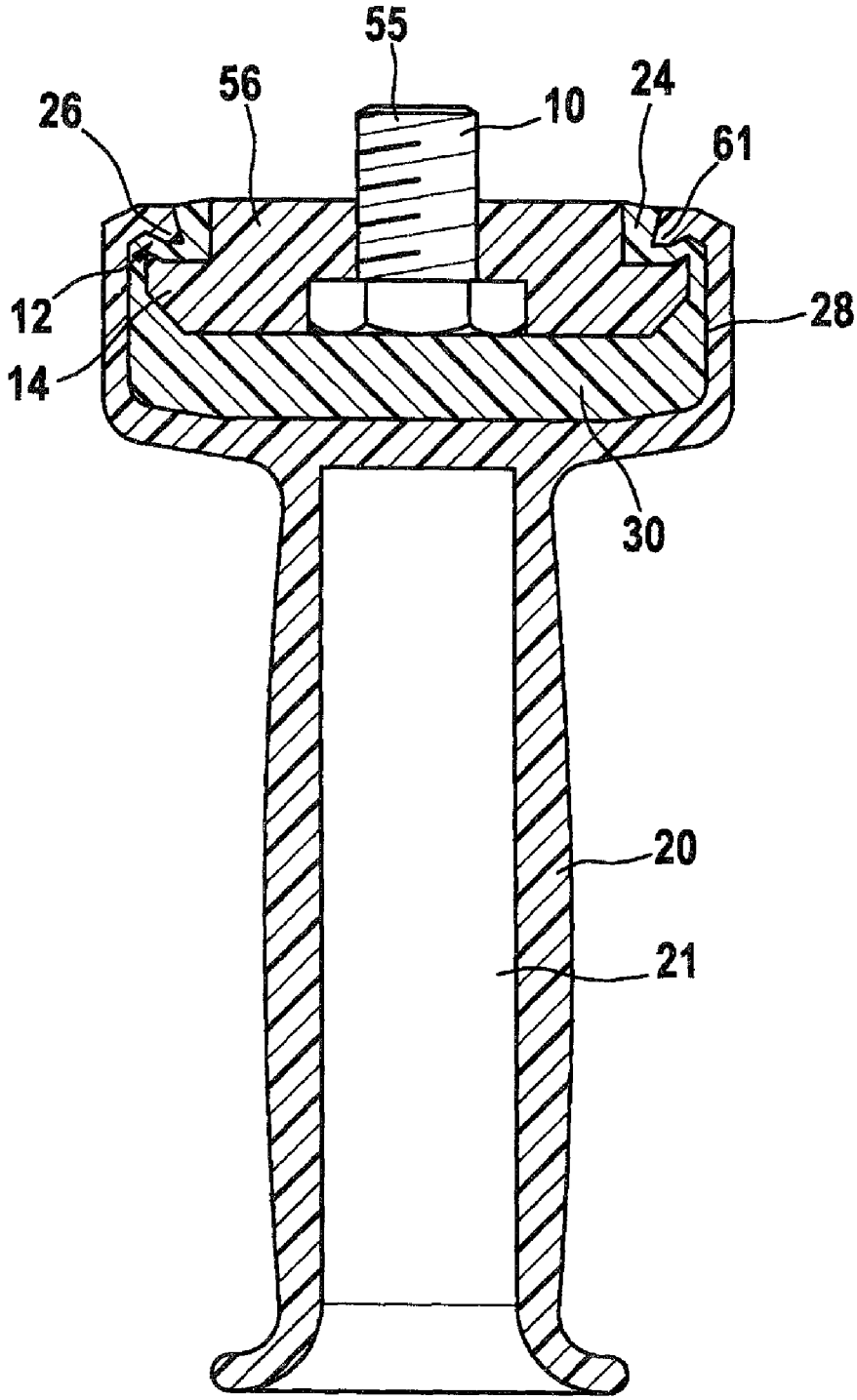
FIG. 10 shows an embodiment of an inventive handle with a latch element on the grip element
Figure 11:
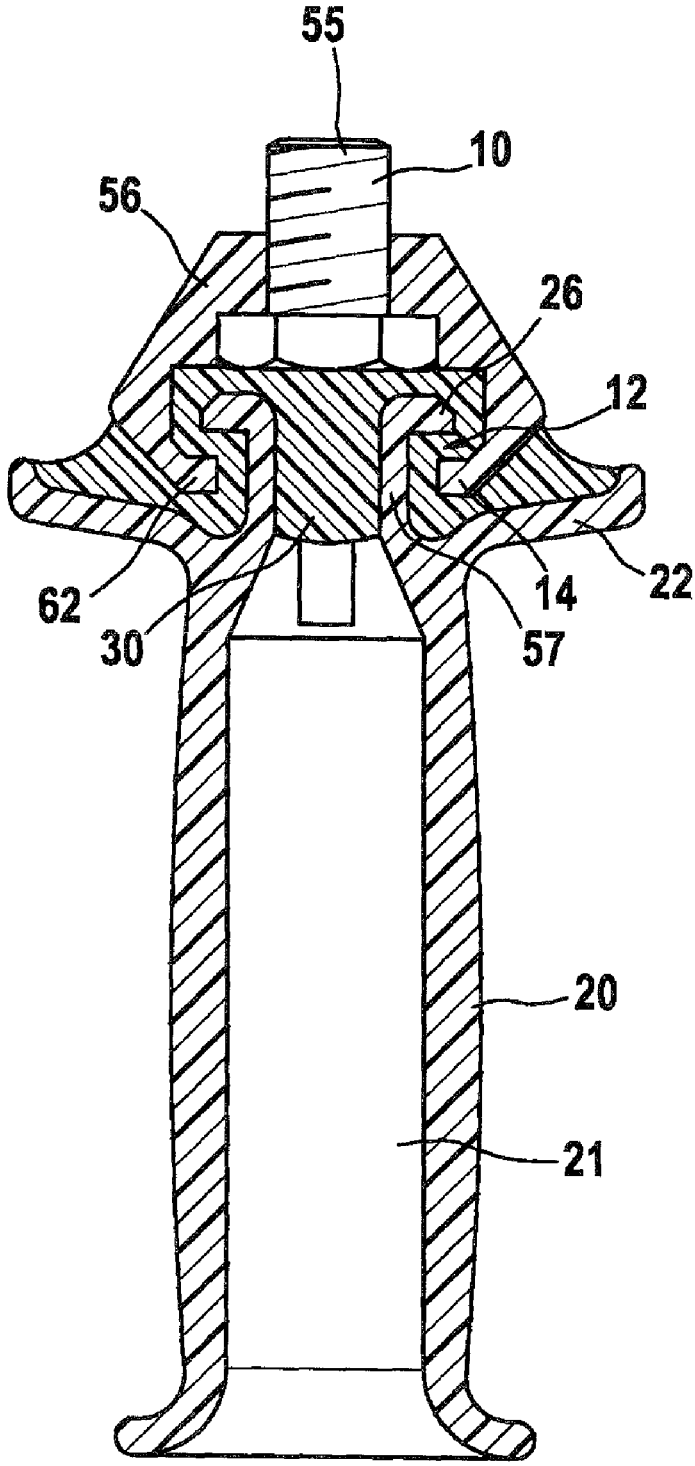
FIG. 11 shows a further embodiment of an inventive handle with a latch element on the fastening element.

FIGS. 10 and 11 show two embodiments, in which a bayonet-type lock is replaced with a latch-type lock. A contactless axial undercut 12 of fastening element 10 relative to grip element 20 is also formed in this case. The latch-type lock is realized by the fact that a latch element 61 is integrally formed with grip element 20, as shown in FIG. 10, and that a latch element 62 is integrally formed with fastening element 10, as shown in FIG. 11. Latch elements 61, 62 are designed as annular, elastic spring elements. As an alternative, one or more latch hooks or the like may be used as latch elements 61, 62, in which case, several latch hooks or the like may be located, e.g., equidistantly on the circumference of the grip element and/or the fastening element (not shown).

In the embodiment shown in FIG. 10, a recess 24 for receiving fastening element 10 is provided in head region 28 of grip element 20. An annular latch element 61 is integrally formed with grip element 20 on the edge of recess 24, which serves as undercut element 26. Fastening element 10 is designed as an at least two-pieced part, including a type of threaded bolt 55 and a carrier element 56. Carrier element 56 accommodates threaded bolt 55 at least partially. Undercut elements 16 are formed on the edge of carrier element 56, which reach behind undercut elements 26 of grip element 20 in a contactless manner. A damping element 30 is inserted between grip element 20 and fastening element 10, e.g., in the form of an elastomer that is injected in the intermediate space between grip element 20 and fastening element 10 in head region 22.

A handle of this type is assembled simply by inserting grip element 20 and fastening element 10 into each other, which results in fastening element 10 snapping into place in grip element 20. Fastening element 10 is inserted into recess 24 in the longitudinal direction of the handle and it is inserted into head region 22 to the extent that fastening element 10 is separated from grip element 20 in the axial direction, thereby forming an axial undercut 12. Due to its elasticity, latch element 61 on grip element 20 permits fastening element 10 to be inserted into grip element 20, even through the inner diameter at the edge of recess 24 is smaller than the outer diameter of carrier element 56.

In the embodiment shown in FIG. 11, carrier element 56 of fastening element 10 is provided with a recess 57 into which grip element 20 may be inserted. An annular latch element 62 is integrally formed on the edge of recess 57, which serves as undercut element 14, since it points radially inward into recess 57. Grip element 20 is provided with corresponding undercut elements 26, which point radially outwardly. When grip element 20 is inserted into recess 57, grip element 20 snaps into place in fastening element 10, since latch element 62 is elastically deformable. During assembly, grip element 20 is inserted into recess 57 of fastening element 10 to the extent that it is separated from fastening element 10 in the axial direction, thereby resulting in undercut elements 14, 26 moving into an axial undercut position 12.

What is claimed is:

1. A handle for a hand-held power tool that includes:

a grip element (20), said grip element including a recess comprising at least one undercut element; and a fastening element (10) for attaching the handle to a housing of a hand-held power tool, said fastening element comprising at least one undercut element, wherein said at least one undercut element of said grip element and said at least one undercut element of said fastening element are configured to form complementary structural elements; and a damping element (30) that is provided between the grip element (20) and the fastening element (10), wherein the fastening element (10) and the grip element (20) are spaced apart from one another and located relative to each other such that they form a contactless axial undercut (12, 15) and a contactless undercut (15) that serves as a rotation lock.

2. The handle as recited in claim 1, wherein the damping element (30) is made of an elastomeric material that may be inserted between the grip element (20) and the fastening element (10).

3. The handle as recited in claim 1, wherein the undercut elements (26, 27) of the grip element (20) and the undercut elements (14, 17) of the fastening element (10) are designed to complement each other.

4. A hand-held power tool including a handle as recited in claim 1.

5. A method for manufacturing a handle for a hand-held power tool, comprising the following steps:

providing a grip element (20), said grip element including a recess comprising at least one undercut element; and providing a fastening element (10) for attaching the handle to a housing of a hand-held power tool, said fastening element comprising at least one undercut element, wherein said at least one undercut element of said grip element and said at least one undercut element of said fastening element are configured to form complementary structural elements; and providing a damping element (30) between the grip element (20) and the fastening element (10);

inserting the fastening element 10 in the grip element 20 using an insert-rotate-pull motion such that the fastening element (10) and the grip element (20) are spaced apart from one another and located relative to each other such that they form a contactless axial undercut (12, 15) and a contactless undercut (15) that serves as a rotation lock.

* * * * *